US005100360A

United States Patent [19]

Entzel

[11] Patent Number: 5,100,360

[45] Date of Patent: Mar. 31, 1992

[54] TOY WITH WOBBLING SLIDING MEMBER

[75] Inventor: Terry Entzel, Aurora, Colo.

[73] Assignee: Steven Langer, Denver, Colo.

[21] Appl. No.: 758,294

[22] Filed: Aug. 28, 1991

Related U.S. Application Data

[63] Continuation of Ser. No. 564,531, Aug. 7, 1990, abandoned.

[51] Int. Cl.[5] ..... A63H 29/08

[52] U.S. Cl. ..... 446/169; 446/431; 446/396; 446/437

[58] Field of Search ..... 446/169, 170, 173, 228, 446/437, 489, 396, 431; 273/128 R, 128 A, 128, 58

[56] References Cited

U.S. PATENT DOCUMENTS

| | | | |
|---|---|---|---|
| 811,775 | 2/1906 | Keen et al. | 446/431 |
| 2,218,207 | 5/1940 | Herzinger | 446/325 |
| 2,444,810 | 7/1948 | Creasy | 273/128 |
| 2,760,305 | 8/1956 | Hetrick | 446/392 |
| 3,462,148 | 8/1969 | Fors | 446/170 |
| 3,697,074 | 10/1972 | Duncan | 273/58 |
| 3,710,503 | 1/1973 | Rylands | 446/489 |
| 3,721,041 | 2/1971 | Goldfarb | 446/169 |
| 3,801,103 | 4/1974 | Mazuela | 273/128 |
| 4,213,266 | 7/1980 | Hyland et al. | 273/58 |
| 4,244,584 | 1/1981 | Viveiros | 273/58 |
| 4,356,915 | 11/1982 | Phillips . | |
| 4,408,761 | 10/1983 | McAllister | 273/128 |
| 4,793,769 | 12/1988 | Dolan | 273/128 |

FOREIGN PATENT DOCUMENTS

| | | | |
|---|---|---|---|
| 485351 | 1/1929 | Fed. Rep. of Germany | 446/73 |
| 2012239 | 10/1971 | Fed. Rep. of Germany | 446/431 |
| 1210868 | 2/1986 | U.S.S.R. | 446/325 |

*Primary Examiner*—Robert A. Hafer
*Assistant Examiner*—David J. Kenealy
*Attorney, Agent, or Firm*—Amster, Rothstein & Ebenstein

[57] ABSTRACT

A toy includes a tiltable structure having a generally flat surface and an upstanding rim disposed about the periphery of the flat surface, an inverted cup-like member having an open bottom, and a ball disposed partially within the cup-like member and partially therebelow. The ball is configured for free rolling motion over the flat surface within the confines of the upstanding rim when the flat surface is tilted relative to the horizontal. The ball is dimensioned to continuously support at least some portion of the bottom of the cup-like member spaced above the flat surface, whereby movement of the ball over the flat surface carries with it the cup-like member which moves over the flat surface with a wobbling sliding movement.

10 Claims, 3 Drawing Sheets

FIG. 2
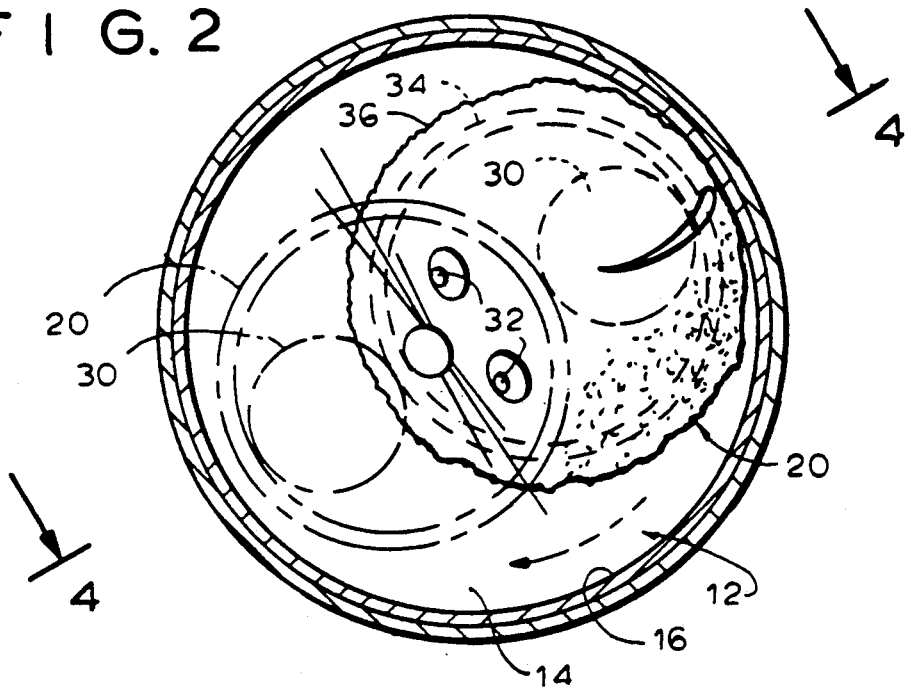
FIG. 3
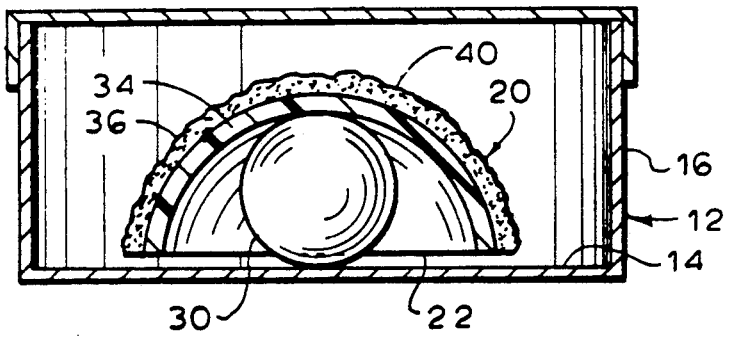
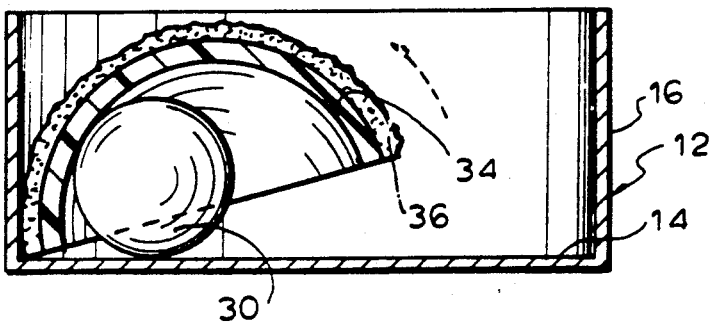
FIG. 4

TOY WITH WOBBLING SLIDING MEMBER

This is a continuation of copending application(s) Ser. No. 07/564,531 filed on Aug. 7, 1990, abandoned.

BACKGROUND OF THE INVENTION

The present invention relates to a toy and, more particularly, to a toy having a member exhibiting a wobbling sliding movement.

The present invention is directed to a toy intended to be played solely for amusement and not as a game of skill. Accordingly, it is different in both structure and conception from the game of skill described in U.S. Pat. No. 3,801,103 requiring a tiltable game board with an upstanding sidewall, an inverted cup, and at least two balls. In that game the cup is provided with an annular rim which extends outwardly from the periphery thereof adjacent the bottom to severely limit any wobbling of the inverted cup as it moves across the tilted game board surface until the cup rim hits the upstanding sidewall about the tiltable game board. The impact then causes the cup to tilt sufficiently to enable another ball to enter under the cup. By way of contrast, the toy of the present invention is played solely for amusement, has an inverted cup member which is devoid of any means for limiting or preventing wobbling as it moves across the tilted surface, and has only one ball disposed within the inverted cup. The toy is designed to provide amusement because of the wobbling sliding movement exhibited by the inverted cup as it travels over the tilted surface.

Accordingly, it is an object of the present invention to provide a toy in which the member exhibits an amusing wobbling sliding movement across a tilted surface.

Another object is to provide such a toy which is of rugged construction and is economical to construct and maintain.

SUMMARY OF THE INVENTION

It has now been found that the above and related objects of the present invention are obtained in a toy comprising a tiltable structure, a hollow housing, such as an inverted cup-like member, and a ball. The tiltable structure has a generally flat surface and an upstanding rim disposed about the periphery of the flat surface. The hollow housing is deposed with its opening facing downwardly. The ball is dimensioned to be disposed partially within said hollow housing and partially therebelow. The ball is configured for free rolling motion over the flat surface within the confines of the upstanding rim when the flat surface is tilted relative to the horizontal. The ball is dimensioned to continuously support at least some portion of the bottom of the housing spaced above the flat surface. Accordingly, movement of the ball over the flat surface carries with it the hollow housing which moves over the flat surface within the tiltable structure with a wobbling sliding movement.

In a preferred embodiment, the ball is substantially heavier than the hollow housing and continuously supports some major portion of the bottom of the hollow housing spaced above the flat surface. The hollow housing is devoid of any means precluding its movement over the flat surface with a wobbling sliding movement, and in particular is devoid of any annular rim projecting substantially outwardly therefrom. Preferably the hollow housing includes on the outer surface thereof elements which may be set in motion relative to the cup-like member by a movement of the hollow housing and which may continue in motion after termination of the aforesaid movement of the hollow housing. For example, the hollow housing may have the appearance of an animal character and the elements may have the appearance of portions of the eyes thereof (i.e., eyeballs). The flat surface may contain irregularities which are small in height relative to the diameter of the ball to enhance the wobbling sliding movement.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 2 is a top plan view thereof, partially in cross section, with the cup-like member and ball being shown in one position in solid line and another position in phantom line;

FIG. 3 is a side elevational view thereof, partially in cross section;

FIG. 4 is a sectional view thereof, with the cover removed, taken along the line 4—4 of FIG. 2.

DETAILED DESCRIPTION OF THE PREFERRED EMBODIMENTS

Figure 5:
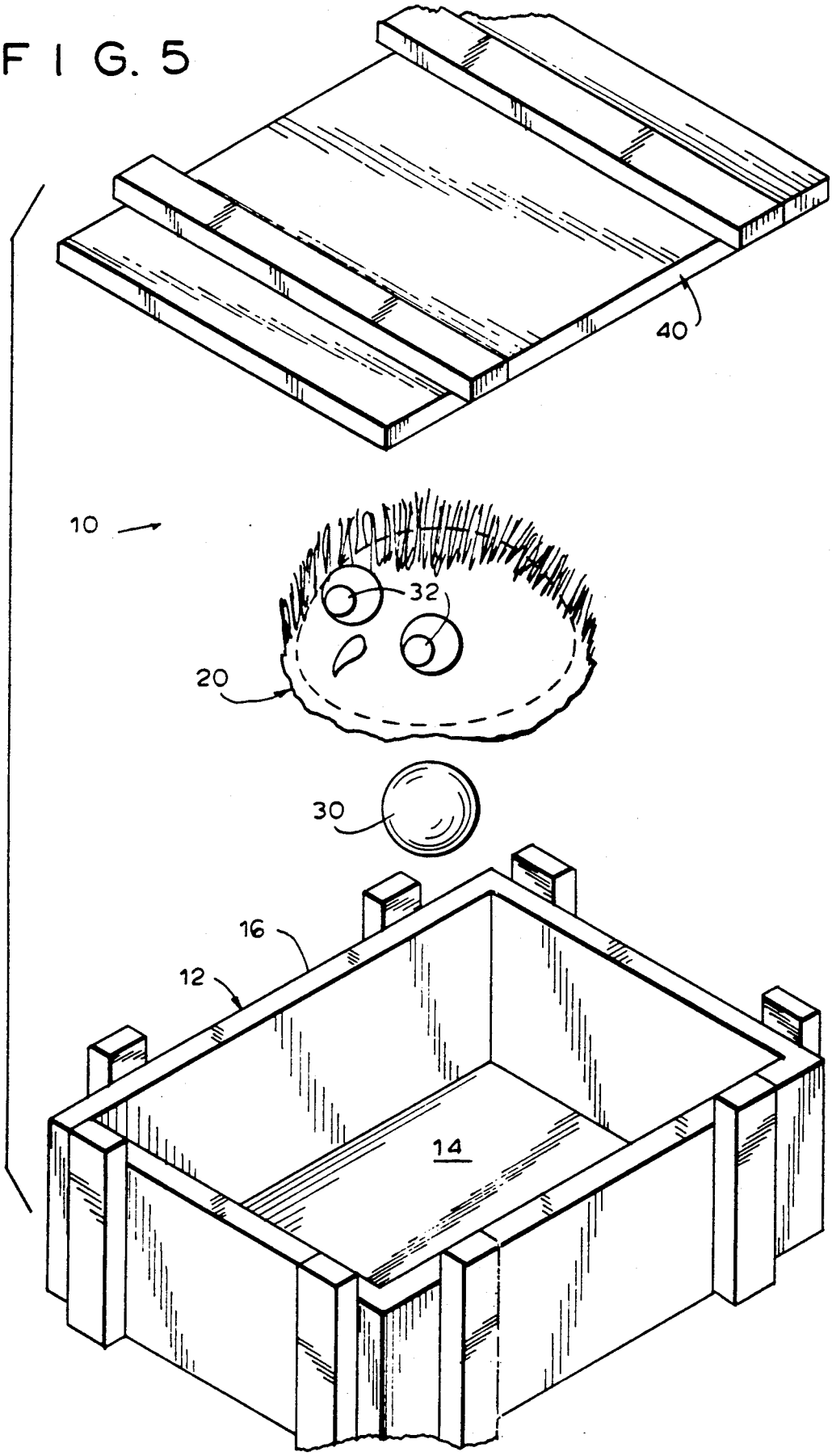
FIG. 5 is an exploded isometric view of a second embodiment.

Referring now to the drawing, and in particular to FIGS. 1–4 thereof, therein illustrated is a toy, generally designated by the reference numeral 10, according to the present invention. The toy 10 includes a tiltable structure, generally designated 12, having a generally flat surface or base 14 and an upstanding rim or sidewall 16 about the periphery of the base 14. The base 14 is illustrated as circular in FIGS. 1–4, but in alternative embodiments may be rectangular, as illustrated in FIG. 5, square or of any desired configuration.

A hollow housing 20, preferably in the form of an inverted cup-like member 20 has an open bottom 22. The inverted cup-like member 20 is preferably hemispherical in configuration, although other hollow housing configurations may also be used which terminate in an open bottom having a peripheral edge. For example, other inverted segments of a sphere may be used.

A ball 30 is disposed partially within the cup-like member 20 and partially therebelow, the ball 30 extending through the open bottom 22 (see FIGS. 3 and 4) of the inverted cup-like member 20. The ball 30 is configured for free rolling motion over the base 14, under the influence of gravity, when the structure 12 (and hence the base 14) is tilted related to the horizontal. The ball is dimensioned to continuously support at least some portion of the bottom 22 of the cup-like member 20 spaced above the base 14. In other words, assuming that the cup is hemispherical in configuration, the diameter of the ball 30 is greater than the radius of the cup 20. Preferably the ball 30 is substantially heavier than the cup-like member 20 and continuously supports some major portion of the bottom 22 of the cup-like member 20 spaced above the base 14 even though, most of the time, some minor portion of the bottom 22 of the cup-like member 20 is also in contact with the base 14. As illustrated in FIG. 3, when the ball is disposed medially of the internal surface of the housing in a substantially equilibrium position, the diameter of the ball is such that the peripheral edge of the housing is in spaced relationship to the flat surface substantially throughout the extent of the peripheral edge and, as illustrated in FIG. 4, the ball can translate in all directions from the substantially equilibrium position towards the peripheral edge. In a preferred embodiment where the internal surface of the housing is curved (like an inverted segment of a sphere), the ball, when disposed medially thereof in a substantially equilibrium position supports the housing above the flat surface substantially throughout the circumferential extent of the peripheral edge and the ball can translate a substantial distance in all directions of a plane from the substantially equilibrium position towards the peripheral edge.

The cup-like member 20 is devoid of any means precluding its movement over the base 14 with a wobbling sliding movement, and in particular is devoid of any annular rim projecting substantially outwardly therefrom. Accordingly, the movement of the ball 30 over the base 14 under the influence of gravity carries with it the cup-like member 20, which moves over the base 14 with a wobbling sliding movement. To enhance the wobbling sliding movement, the generally flat base 14 may contain irregularities which are small in height relative to the diameter of the ball 30, so that the travel path of the ball 30 is irregular, thus causing irregular movement of the cup-like member 20.

As the purpose of the upstanding rim 16 about the base 14 is to preclude escape of the ball 30 and cup-like member 20 from the structure 12, the height of the upstanding rim 16 is preferably at least equal to the radius of the ball 30 and optimally intermediate the radius and the diameter of the ball 30. The cup-like member 20 should extend sufficiently about the ball 30 such that, even when the cup-like member 20 abuts against the upstanding rim 16 of the structure 12 and is somewhat tilted thereby (as illustrated in FIG. 4), with one portion of the open bottom approaching the base 14 and an opposed portion of the bottom 22 retreating from the base 14, the ball 30 and the cup-like member 20 are still precluded from unintentional separation. The structure 12 may define a maze or other arrangement of interior walls, the challenge being to move the cup-like member 20 through the maze. Preferably the size of the base 14 is such as to permit frequent interaction between the cup-like member 20, on one hand, and the upstanding rim 16 or any interior walls, on the other hand.

The structure 12 may be formed of wood, metal, plastic or the like depending upon what level of noise is desired as the ball 30 moves over the base 14 and as the cup-like member 20 impacts upon the upstanding rim 16. The inner surface 34 of cup-like member 20 is preferably formed of a lightweight plastic or metal, and the outer surface 36 thereof may be decorated with paint, artificial hair, and similar conventional doll components. The ball 30 is preferably made of a heavyweight metal or like dense material, so that it develops sufficient momentum to carry the cup-like member 20 along with it.

Preferably the cup-like member outer surface 36 includes elements 32 which may be set in motion relative to the cup-like member 20 by a movement of the cup-like member 20 and which may continue in motion after termination of the aforesaid movement of the cup-like member 20. For example, the cup-like member 20 may have coiled springs projecting outwardly and upwardly therefrom. Preferably the cup-like member 20 is molded or decorated so as to have the appearance of an animal character, a human character, a cartoon character, a mythological character or the like. The elements 32 on the outer surface 36 may have the appearance of being portions of the eyes of the character, for example, the eyeballs thereof. Alternatively, where the outer surface 36 has the appearance of an insect and the elements 32 are springs, the elements 32 may have the appearance of antennae for the insect. Clearly the variety of appearances suitable for the outer surface 36 are limited only by the imagination of the designer and the limitations of the materials employed. For example, the outer surface 36 may be decorated to resemble football or baseball team helmets, with the structure 12 being decorated to represent an athletic playing field.

Figure 1:
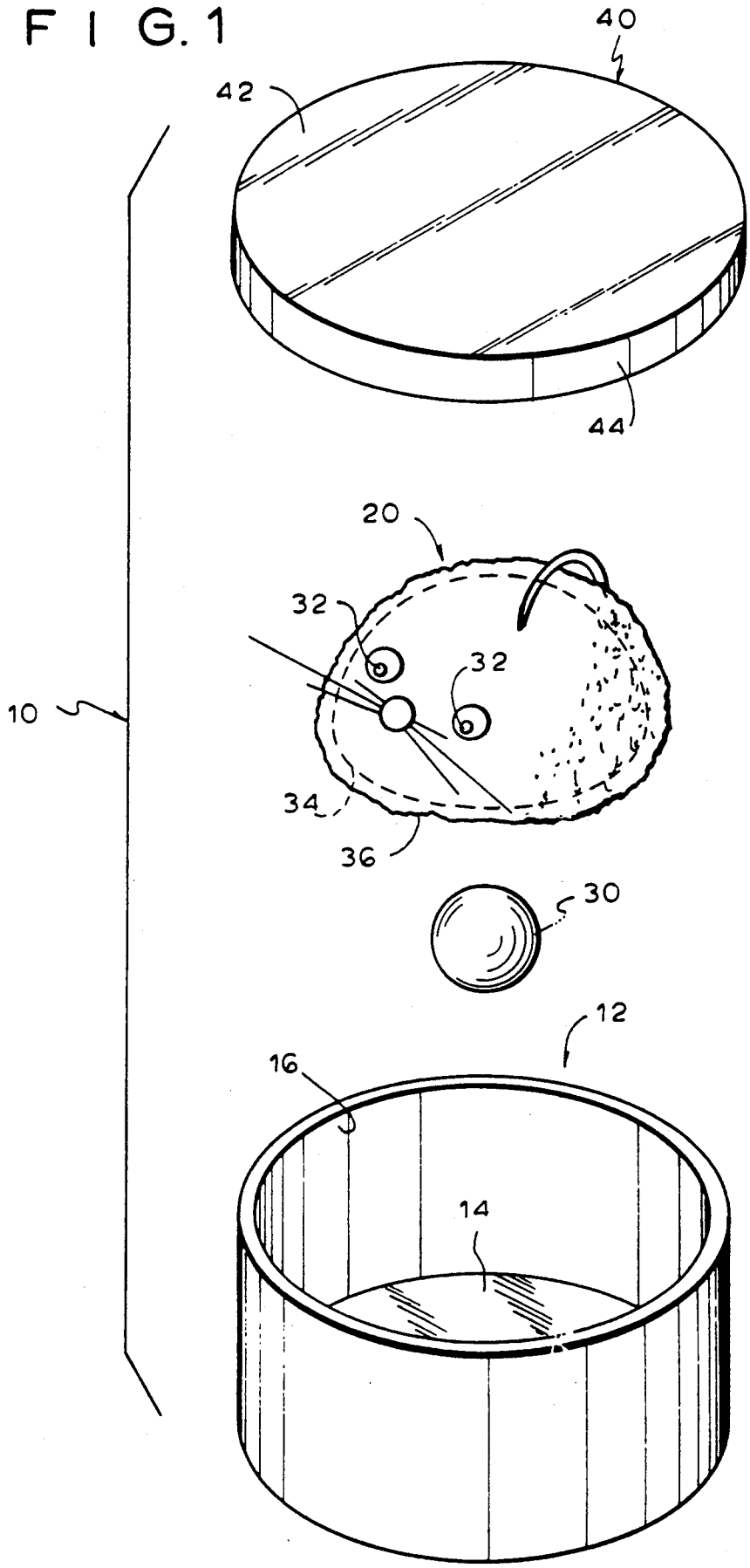
FIG. 1 is an exploded isometric view of a toy according to the present invention.

To facilitate storage of the structure 12, the cup-like member 20 and the ball 30 as a unit, a cover, generally designated 40, is preferably provided. As illustrated in FIG. 1, the cover 40 includes a generally flat portion 42 and a depending peripheral rim 44. The cover 40 is configured and dimensioned to fit over the top of structure 12 with the depending rim 44 overlying the upstanding rim 16 and the flat portion 42 covering the open top of structure 12 so as to maintain within structure 12 the ball 30 and cup-like member 20.

Referring now to FIG. 5 in particular, therein illustrated is a second embodiment 10' of the present invention. Functionally similar elements of the second embodiment 10' which are identical in function to the elements of the first embodiment 10 have been similarly numbered. In embodiment 10' the structure 12 and cover 40 are formed of wood, the base 14 being rectangular in configuration.

To use the toy, the ball 30 is placed on the upper surface of the base 14 of the structure 12, and the inverted cup-like member 20 is placed over the ball 30. The structure 12 is then tilted from one side to another so as to cause the ball 30 to carry the cup-like member 20 back and forth across the base 14, with the cup-like member 20 exhibiting a wobbling sliding movement amusing for both children and adults.

The entire toy is dimensioned to be held in the hand. The cup-like member 20 moves and bobs in a lifelike manner, jumping where it hits the upstanding rim 16 or any other obstruction, such as a finger or object put in its travel path. Although the ball 30 rolls freely over the base 14, the cup-like member 20 balanced thereon wobbles back and forth. With a little practice, even a child can manipulate the structure 12 in such a way as to make the cup-like member 20 appear to be alive as it rolls, turns, jumps and weaves in response to the hand movements tilting the structure 12. Where the cup-like member 20 has an outer surface having the appearance of the face, the experienced user can cause the cup-like member 20 to appear to be turning, lifting and even peering over the upstanding rim 16, giving quizzical looks, etc.

If desired, the generally flat portion 42 of cover 40 may be transparent to enable the toy to be used with the cover 40 in place. In this case, the cover 40 is optionally permanently attached to the structure 12 and desirably the generally flat portion 42 of the cover 40 is spaced above the base 14 by a distance sufficient to permit relatively free movement of the cup-like member 20 and ball 30 (including tilting or wobbling of the cup-like member 20) without permitting escape of the ball 30 from under the cup-like member 20.

To summarize, the present invention provides an economical, rugged toy for amusement in which a member is made to move across a base with a fascinating wobbling sliding movement.

Now that the preferred embodiments of the present invention have been shown and described in detail, various modifications and improvements thereon will become readily apparent to those skilled in the art. Accordingly, the spirit and scope of the present invention is to be limited only by the appended claims, not by the foregoing disclosure.

I claim:

1. A toy comprising:

(A) a tiltable structure having a generally flat surface and an upstanding rim disposed about the periphery of said flat surface;

(B) a hollow housing defining an internal surface terminating in an open bottom having a peripheral edge; and (C) a ball disposed partially within said housing and partially therebelow, said ball being configured for free rolling motion over said flat surface within the confines of said upstanding rim when said flat surface is tilted relative to the horizontal, said ball being dimensioned to continuously support at least some portion of said peripheral edge spaced above said flat surface;

said housing being configured and dimensioned relative to said ball to enable only a minor portion of said peripheral edge to contact said flat surface when said housing is supported by said ball and is spaced from said upstanding rim;

said ball being of a diameter relative to said internal surface of said housing such that, when said ball is disposed medially thereof in a substantially equilibrium position, said peripheral edge of said housing is in spaced relationship to said flat surface substantially throughout the extent of said peripheral edge and said ball can translate in all directions at least 10% of its diameter from said substantially equilibrium position toward said peripheral edge;

whereby movement of said ball over said flat surface carries with it said housing member which moves within said tiltable structure with a wobbling sliding movement.

2. The toy of claim 1 wherein said ball is substantially heavier than said housing and continuously supports substantially all of said bottom of said housing spaced above said flat surface.

3. The toy of claim 1 wherein said housing is devoid of any means, precluding its movement over said flat surface with a substantially sliding movement.

4. The toy of claim 3 wherein said housing is devoid of any annular rim projecting substantially outwardly therefrom.

5. The toy of claim 1 wherein said housing includes on the outer surface thereof elements which may be set in motion relative to said housing by a movement of said housing and which may continue in motion after termination of the aforesaid movement of said housing.

6. The toy of claim 5 wherein said housing has the appearance of an animal character and said elements have the appearance of portions of the eyes thereof.

7. The toy of claim 1 wherein said internal surface of said housing is configured as an inverted cup.

8. A toy comprising:

(A) a tiltable structure having a generally flat surface and an upstanding rim disposed about the periphery of said flat surface;

(B) a hollow housing configured as an inverted cup-like member having an open bottom, said housing being devoid of any means precluding its movement over said flat surface with a substantially sliding movement, and including on the outer surface thereof elements which may be set in motion relative to said housing by a movement of said housing and which may continue in motion after termination of the aforesaid movement of said housing; and (C) a ball disposed partially within said housing and partially therebelow, said ball being substantially heavier than said housing and configured for free rolling motion over said flat surface within the confines of said upstanding rim when said flat surface is tilted relative to the horizontal, said ball being dimensioned to have a diameter not exceeding 80% of the inner diameter of said housing and to continuously support substantially all of said bottom of said housing spaced above said flat surface;

said housing being configured and dimensioned relative to said ball to enable only a minor portion of said bottom of said housing to contact said flat surface when said housing is supported by said ball and spaced from said upstanding rim;

whereby movement of said ball over said flat surface carries with it said housing member which moves within said tiltable structure with a wobbling sliding movement.

9. The toy of claim 1 wherein said ball is freely movable over said flat surface relative to said housing within the confines of said internal surface of said housing.

10. The toy of claim 1 wherein said housing defines an internal surface which is an inverted segment of a sphere, and said ball is of a diameter relative to the curvature of said internal surface of said housing such that, when said ball is disposed medially thereof in a substantially equilibrium position, said peripheral edge of said housing is in spaced relationship to said flat surface substantially throughout the circumferential extent of said peripheral edge and said ball can translate a substantial distance in all directions of a plane from said substantially equilibrium position toward said peripheral edge.

* * * * *